US005208610A

United States Patent [19]

Su et al.

[11] Patent Number: 5,208,610

[45] Date of Patent: May 4, 1993

[54] PEN CARRIAGE FOR AN INK-JET PRINTER

[75] Inventors: Wen-Li Su; J. P. Harmon, both of Vancouver, Wash.; Les R. Pierce, Hillsboro, Oreg.

[73] Assignee: Hewlett-Packard Company, Palo Alto, Calif.

[21] Appl. No.: 738,718

[22] Filed: Jul. 31, 1991

[51] Int. Cl.[5] ..... B41J 2/07; B41J 25/34

[52] U.S. Cl. ..... 346/140 R; 346/139 R; 400/175; 400/352

[58] Field of Search ..... 346/140 R, 75, 76 PH, 346/139 R; 400/352, 126, 175

[56] References Cited

U.S. PATENT DOCUMENTS

| | | | |
|---|---|---|---|
| 4,135,245 | 1/1979 | Kemplin et al. | 364/520 |
| 4,573,129 | 2/1986 | Tribolet et al. | 364/520 |
| 4,709,246 | 11/1987 | Piatt et al. | 346/140 R |
| 4,709,247 | 11/1987 | Piatt et al. | 346/140 R |
| 4,712,172 | 12/1987 | Kiyohara et al. | 346/1.1 |
| 4,755,836 | 7/1988 | Ta et al. | 346/140 R |
| 4,872,026 | 10/1989 | Rasmussen et al. | 346/140 R |
| 4,907,018 | 3/1990 | Pinkerpell et al. | 346/139 R |
| 5,023,628 | 6/1991 | Koch | 346/76 PH |

OTHER PUBLICATIONS

*Integrating the Printhead into the HP Deskjet Printer,* Hewlett-Packard Journal, Oct. 1988, pp. 62-66.

*Development of a High-Resolution Thermal Inkjet Printhead,* Hewlett-Packard Journal, Oct. 1988, pp. 55-61.

*Primary Examiner*—Benjamin R. Fuller

*Assistant Examiner*—N. Le

[57] ABSTRACT

The carriage is configured for interchangeably holding pens of different sizes at the same position relative to a circuit that is mounted to the carriage. In a preferred embodiment, a black-ink pen or a relatively large color-ink pen may be carried by the carriage. The size of the carriage opening into which the pen is inserted is reduced by a spacer mechanism to accommodate the smaller pen, which spacer mechanism is retracted from the opening upon insertion of the larger pen.

14 Claims, 6 Drawing Sheets

PEN CARRIAGE FOR AN INK-JET PRINTER

BACKGROUND OF THE INVENTION

This invention pertains to pen carriages for ink-jet printers.

Presently available are ink-jet printer pens that contain only black ink (hereafter referred to as black pens). Also available are pens that carry inks of subtractive primary colors (cyan, magenta, and yellow), which may be used for printing a variety of colors, including black (these pens hereafter referred to as color pens).

Certain ink-jet printers use pens that include a plurality of nozzles through which ink drops are discharged. Each pen nozzle has associated with it a thin-film resistor that is selectively driven (heated) with sufficient current for vaporizing ink in the vicinity of the nozzle, thereby forcing through the nozzle a drop of ink. Drive lines to each nozzle resistor are carried upon a circuit that is mounted to the exterior of the pen. Circuit contact pads on the pen-mounted circuit connect with mating pads on a corresponding circuit that is mounted to the carriage.

An ink-jet printer manufactured by Hewlett-Packard Company and designated the "DeskJet" printer includes a carriage for holding a black pen. The carriage is reciprocated across the width of a sheet of paper that is advanced through the printer.

The carriage includes features that mate with reference members formed on the pen. The pen is installed in the printer by lowering the pen into a chute formed in the carriage. The reference members of the pen are guided by the chute into contact with the carriage features. The pen is then manipulated to pivot about the contacting reference members and features so that the top of the pen moves into engagement with a spring clip mounted to the carriage. When the pen top is so engaged, the pen is clamped to the carriage with the contact pads of the pen-mounted circuit pressed against the contacts pads on the carriage-mounted circuit.

It has been found to be advantageous to configure an ink-jet printer for interchangeably using a black pen and a color pen. The color pen, like the black pen, includes a pen-mounted circuit having exposed contact pads that are configured to connect with the pads on the carriage-mounted circuit. The overall shape of the color pen, however, is somewhat different from that of the black pen.

SUMMARY OF THE INVENTION

This invention is directed to a printer carriage that is configured for interchangeably holding pens of different shapes. Pens of different shape are held by a single carriage that automatically adjusts its configuration each time a pen of one shape is replaced with a pen of another shape. In this regard, the carriage chute is configured to guide different-shaped pens into contact with a single set of carriage features. Only one carriage-mounted circuit, with associated contact pads, is required. Moreover, the space required within a printer for carrying two different-shaped pens is minimized since only one pen is carried at a time. There is no need, therefore, for enlarging the printer or carriage to accommodate, for example, two pens simultaneously carried side-by-side. Moreover, since a single-pen carriage is lighter than a two-pen carriage, a relatively smaller, hence, less expensive, carriage drive motor may be used.

DETAILED DESCRIPTION OF A PREFERRED EMBODIMENT

Figure 1:
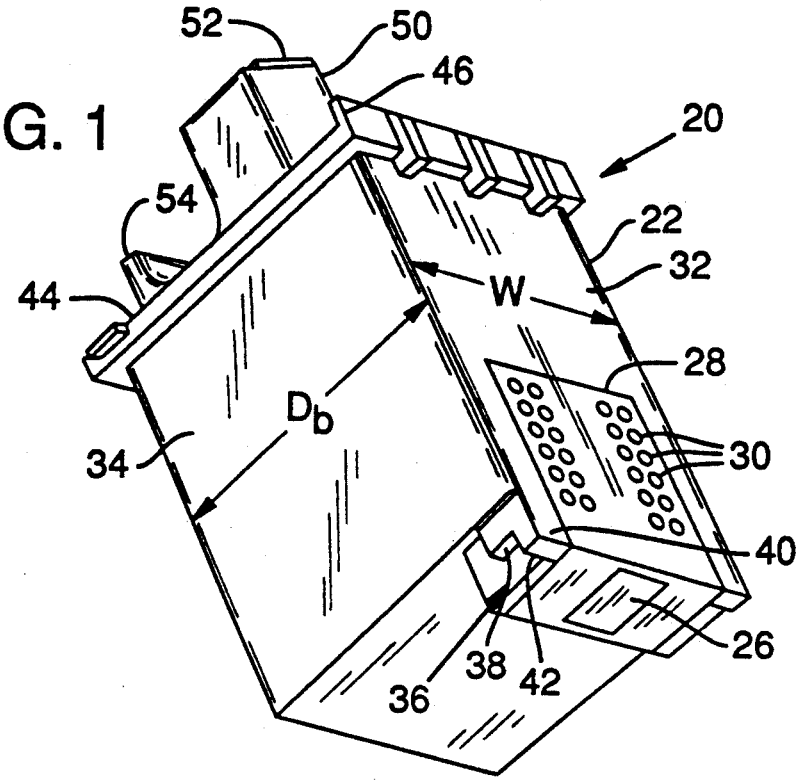
FIG. 1 is a perspective view of a black pen that is used with an ink-jet printer, which pen may be carried by the carriage of the present invention.

FIG. 1 depicts a conventional thermal-type black pen 20 that may be used with an ink-jet printer. The black pen 20 includes a body 22 for containing a reservoir of black ink. The pen 20 has mounted on its underside an orifice plate 26. The orifice plate 26 includes a plurality of orifices (not shown) shaped as nozzles through which ink drops are projected to form characters or other information on the paper that is advanced through the printer. Whenever the pen 20 is installed in the printer carriage, the orifice plate 26 is held at a predetermined position relative to the printer carriage, above the paper that moves through the printer.

Each pen nozzle of a thermal-type ink-jet pen has associated with it a thin-film resistor that is selectively driven (heated) with sufficient current for vaporizing ink in the vicinity of the nozzle. The consequent expansion of the ink forces a drop of ink through the nozzle. Drive lines to each nozzle resistor are carried upon a flexible circuit 28 that is mounted to the exterior of the pen body 22. Circuit contact pads 30 (shown enlarged for illustration) at the end of each resistor drive line connect with similar pads carried on a corresponding circuit that is mounted to the carriage, as described below. The portion of the circuit 28 that includes the contact pads 30 is mounted to the front flat face 32 of the pen 20. The signals for firing the nozzle resistors are generated by a microprocessor and associated drivers that apply the firing signals to the resistor drive lines.

Figure 6:
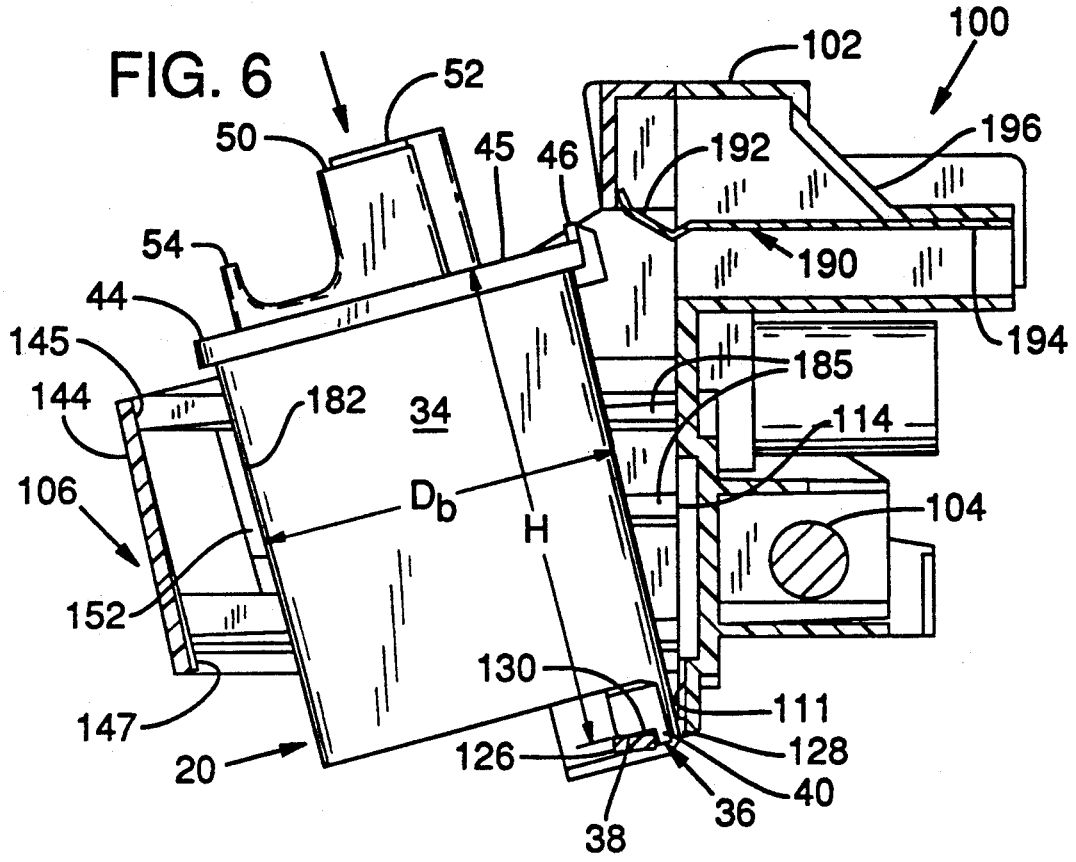
FIG. 6 is a side elevation view, in partial section, showing installation of the black pen.
Figure 6A:
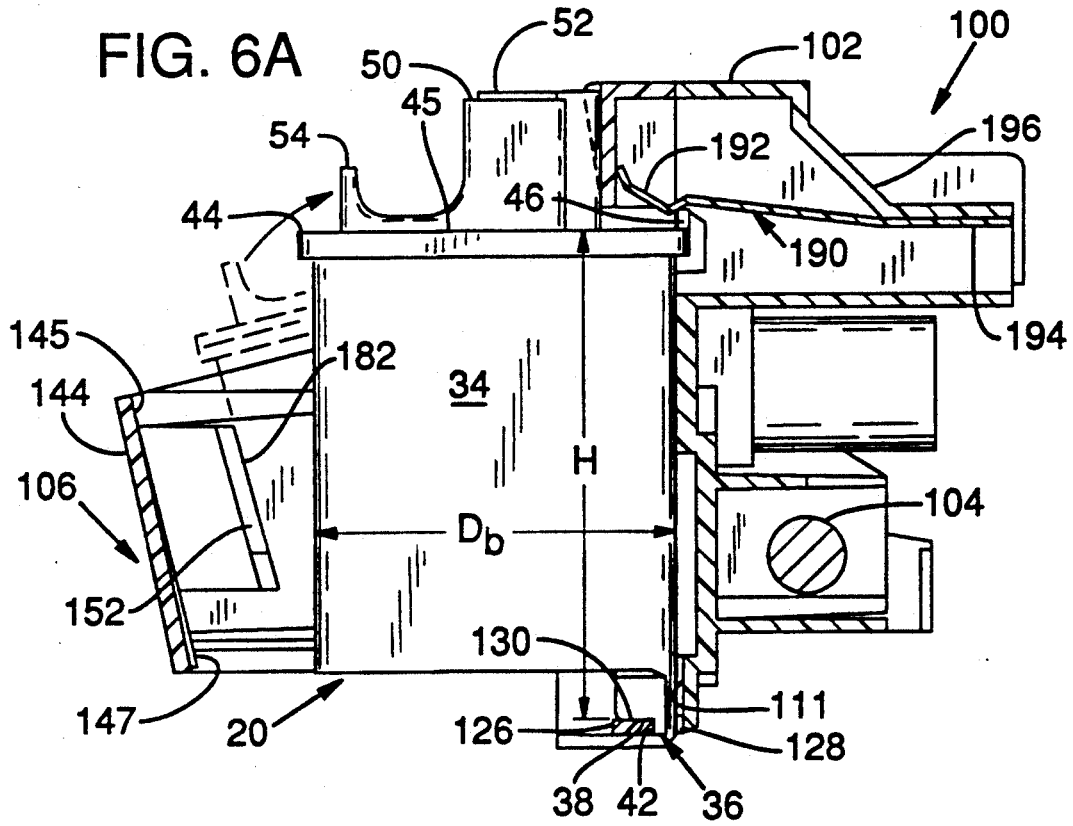
FIG. 6A is a side elevation view, in partial section, showing the black pen completely installed in the carriage.

At the bottom (FIG. 1) of the pen 20, near the front face 32, each opposing sidewall 34 of the pen body 22 is formed to define a reference member 36. The reference member 36 is formed to have a horizontal reference surface 38 that extends inwardly from the outer surface of the sidewall 34. The reference member 36 also includes a toe 40 that extends forward of, and slightly beneath, the horizontal reference surface 38. The rearward facing surface of the toe 40 defines a vertical reference surface 42 that extends inwardly from the outer surface of the sidewall 34. The horizontal reference surface 38 and the vertical reference surface 42 are formed in planes that intersect at a 90° angle (FIG. 6A).

Figure 5:
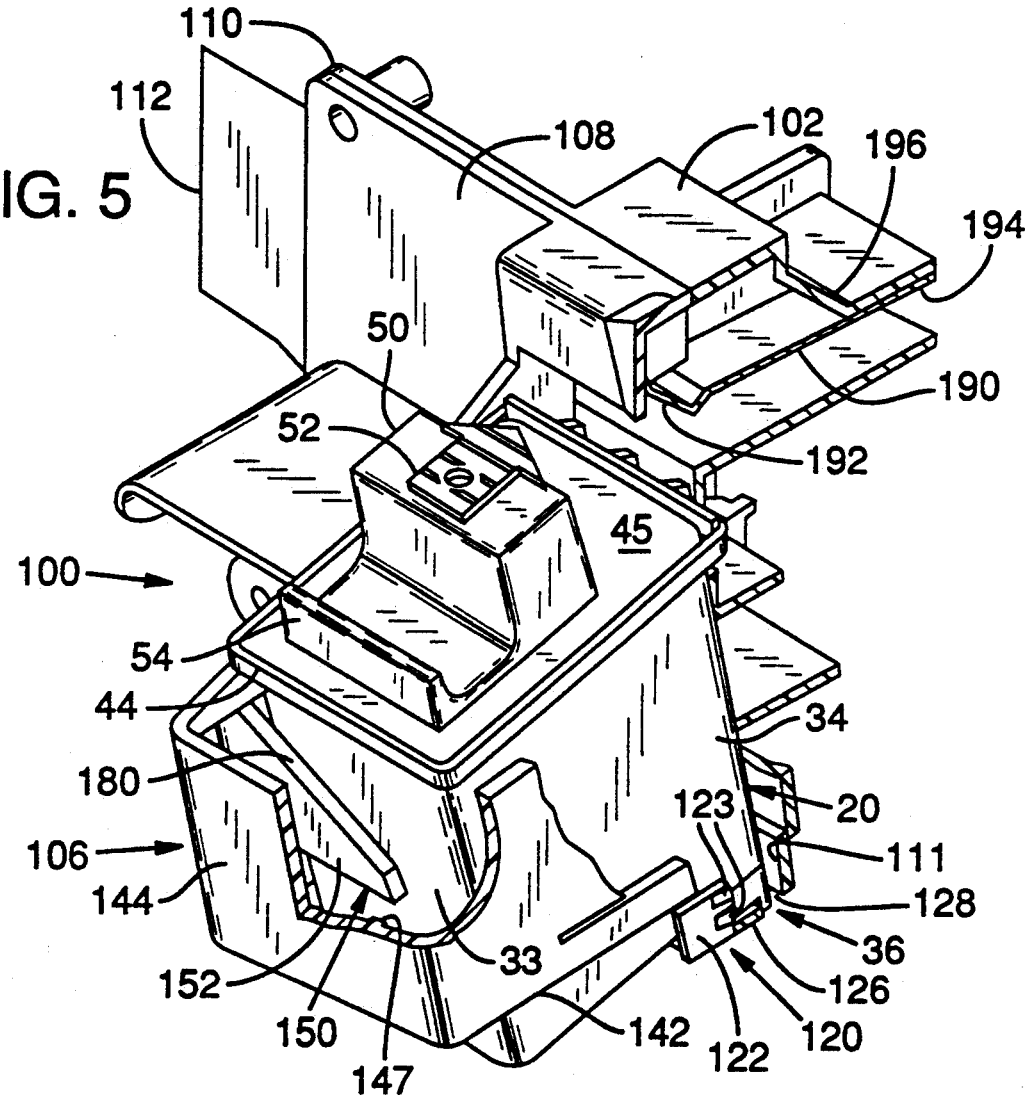
FIG. 5 is a perspective view, in partial section, showing installation of a black pen into the carriage.

The top 44 of the black pen 20 includes an upwardly protruding lip 46 that extends across the top of the front face 32. To the rear of the lip 46 a cap 50 protrudes upwardly. The cap 50 includes an internal vent (not shown) to the reservoir interior. The cap 50 also carries arrow-shaped indicia 52 (FIG. 5) pointing toward the front face 32 of the pen body 22. The rearward portion of the cap 50 is formed into an upwardly projecting handle 54 for manipulating the pen 20 during installation and removal, as described below.

Figure 2:
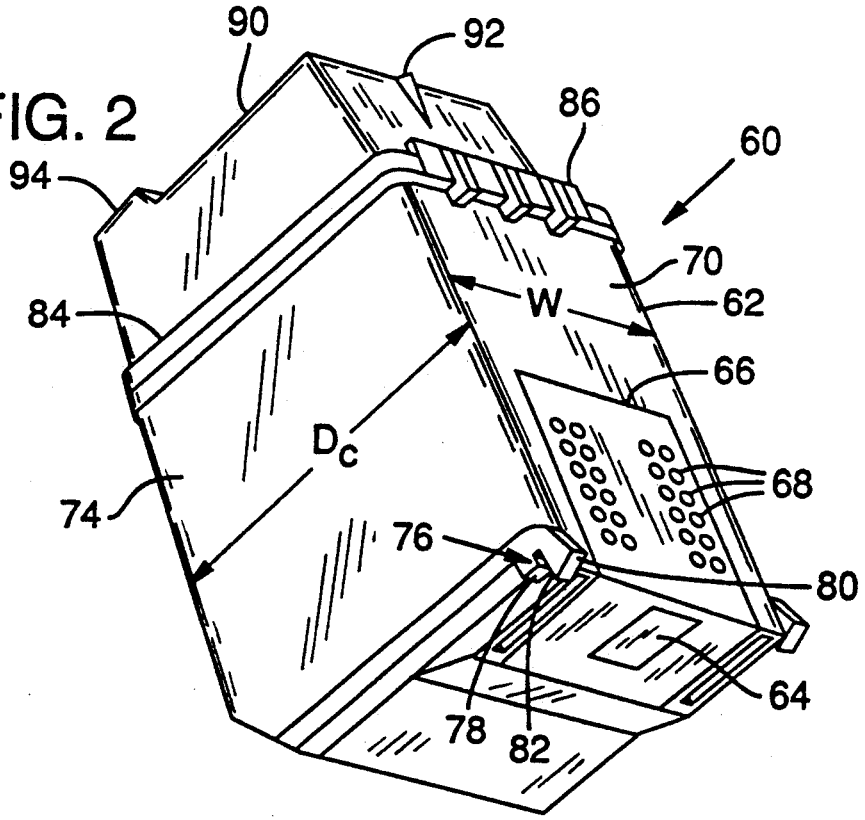
FIG. 2 is a perspective view of a color pen that is used with an ink-jet printer, which pen may be carried by the carriage of the present invention.

FIG. 2 depicts a conventional thermal-type color pen 60 used with an ink-jet printer. The color pen 60 includes a body 62 for containing reservoirs of colored ink. The pen 60 has mounted to its underside an orifice plate 64. The orifice plate 64 includes a plurality of orifices (not shown) shaped as nozzles through which ink drops are projected. As with the black pen 20, the orifice plate 64 of the color pen 60 is held at a predetermined position relative to the printer carriage whenever the pen 60 is installed in the carriage. A flexible circuit 66 is mounted to the exterior of the pen body 62. Circuit contact pads 68 are exposed on the portion of the circuit 66 that is mounted to the front face 70 of the pen 60.

The pen-mounted circuit 66 carries drive lines to the resistors associated with each nozzle. The circuit contact pads 68 connect with corresponding pads on the carriage-mounted circuit for conducting firing signals from the microprocessor to the nozzle resistors.

Figure 10:
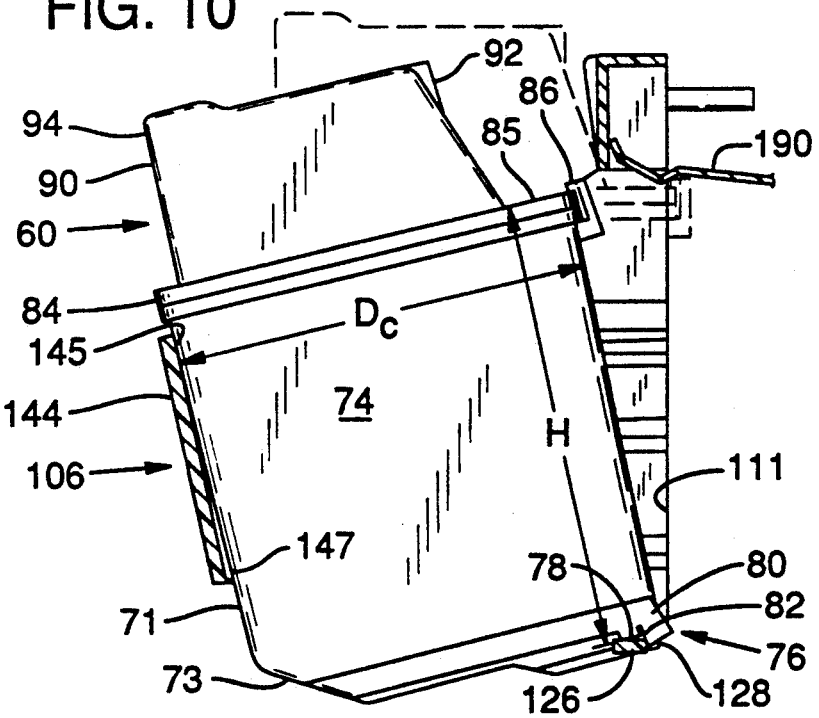
FIG. 10 is a side elevation view, in partial section, showing installation of the color pen in the carriage.

At the bottom (FIG. 2) of the pen 60, near the front face 70, each opposing sidewall 74 of the pen body 62 is formed to define a reference member 76. The reference member 76 is formed to have a horizontal reference surface 78 that extends inwardly from the outer surface of the pen sidewall 74. The reference member 76 also includes a toe 80 that extends forward of, and slightly beneath, the horizontal reference surface 78. The rearward facing surface of the toe 80 defines a vertical reference surface 82 that extends inwardly from the surface of the sidewall 74. The horizontal reference surface 78 and the vertical reference surface 82 of the reference member 76 are formed in planes that intersect at a 90° angle (FIG. 10).

Figure 9:
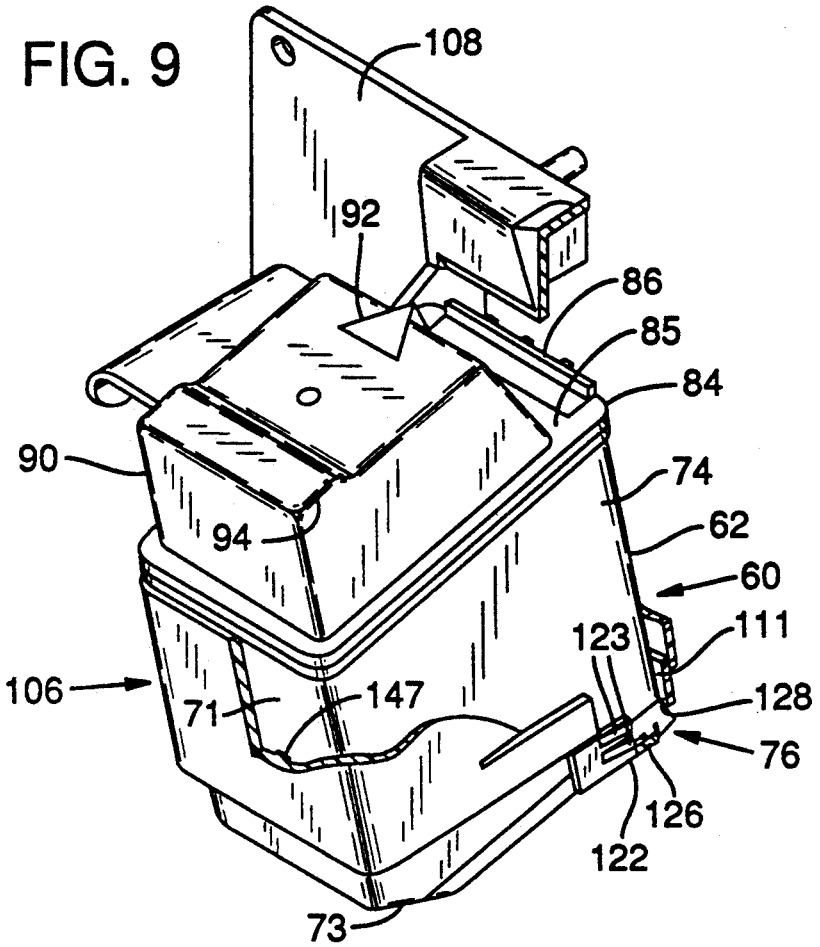
FIG. 9 is a perspective view, in partial section, showing installation of a color pen in the carriage.

The top 84 of the color pen 60 includes an upwardly protruding lip 86 that extends across the top of the front face 70. To the rear of the lip 86 a cap 90 protrudes upwardly. The cap 90 also carries arrow-shaped indicia 92 (FIG. 9) pointing toward the front face 70 of the pen body 62. The rearward portion of the cap 90 includes an upwardly projecting handle portion 94 for manipulating the pen 60 during installation and removal from the carriage as described below.

For the purposes of this description, it is noteworthy that both the black pen 20 and the color pen 60 are constructed so that the position of the contact pads 30 on the black pen-mounted circuit 28 relative to the position of the horizontal reference surface 38 and vertical reference surface 42 corresponds to the position of the contact pads 68 of the color pen-mounted circuit 66 relative to the horizontal reference surface 78 and vertical reference surface 82 of the color pen reference member 76. Moreover, the width (shown as dimension "W" in FIGS. 1 and 2) of the black pen front face 32 and the color pen front face 70 are substantially equal.

Although the width W is shown as constant from pen top to bottom, it is contemplated that the width W may diminish slightly in the downward direction in pens that are made, for example, by injection molding and include a taper known as draft.

The height "H" of the black pen 20, as measured between the horizontal reference surface 38 and the upper surface 45 of the pen top 44 (FIGS. 6 and 6A), is substantially the same as the correspondingly measured height "H" between the horizontal reference surface 78 of the color pen 60 and the upper surface 85 of the pen top 84.

The depth $D_b$ of the pen body 22 (FIG. 1), as measured between the front face 32 and the rear surface 33 (FIG. 5) of the black pen 20, is less than the corresponding depth $D_c$ of the color pen body 62 as measured between the front face 70 and the rear surface 71 (FIG. 10) of the color pen 60. The carriage of the present invention is designed so that either the black pen 20 or the color pen 60 may be installed in the carriage and connected to a single carriage-mounted circuit, irrespective of the difference between the depth $D_b$ of the black pen and the depth $D_c$ of the color pen.

Figure 3:
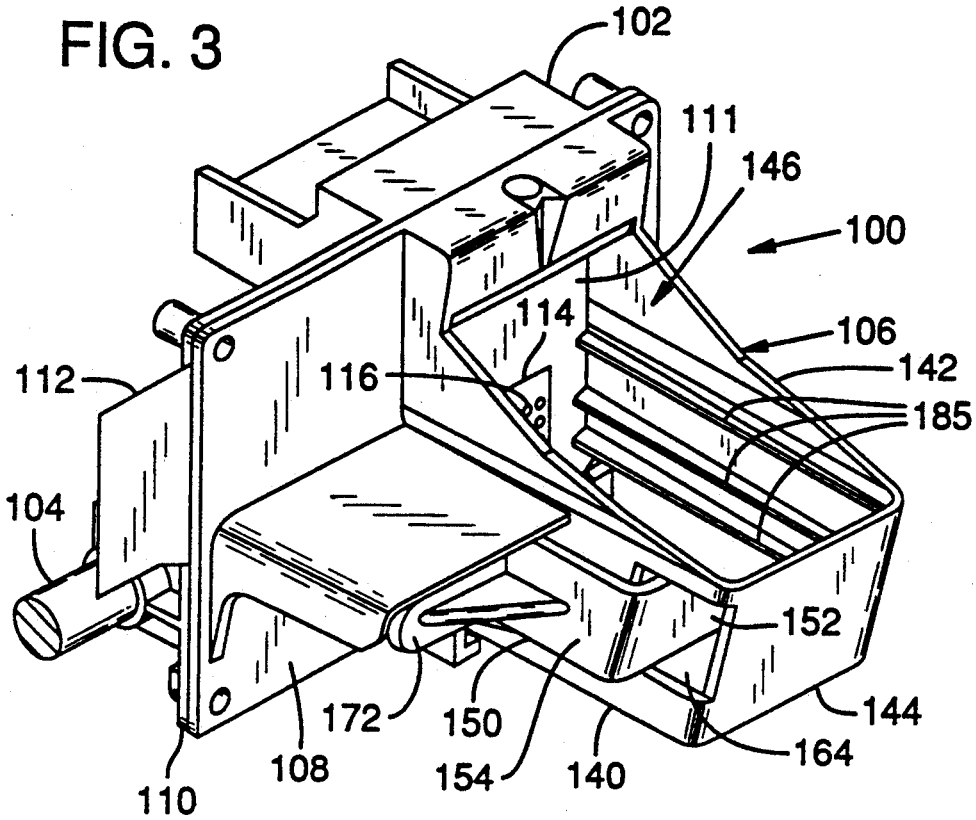
FIG. 3 is a perspective view, from above, of a carriage formed in accordance with the present invention.
Figure 4:
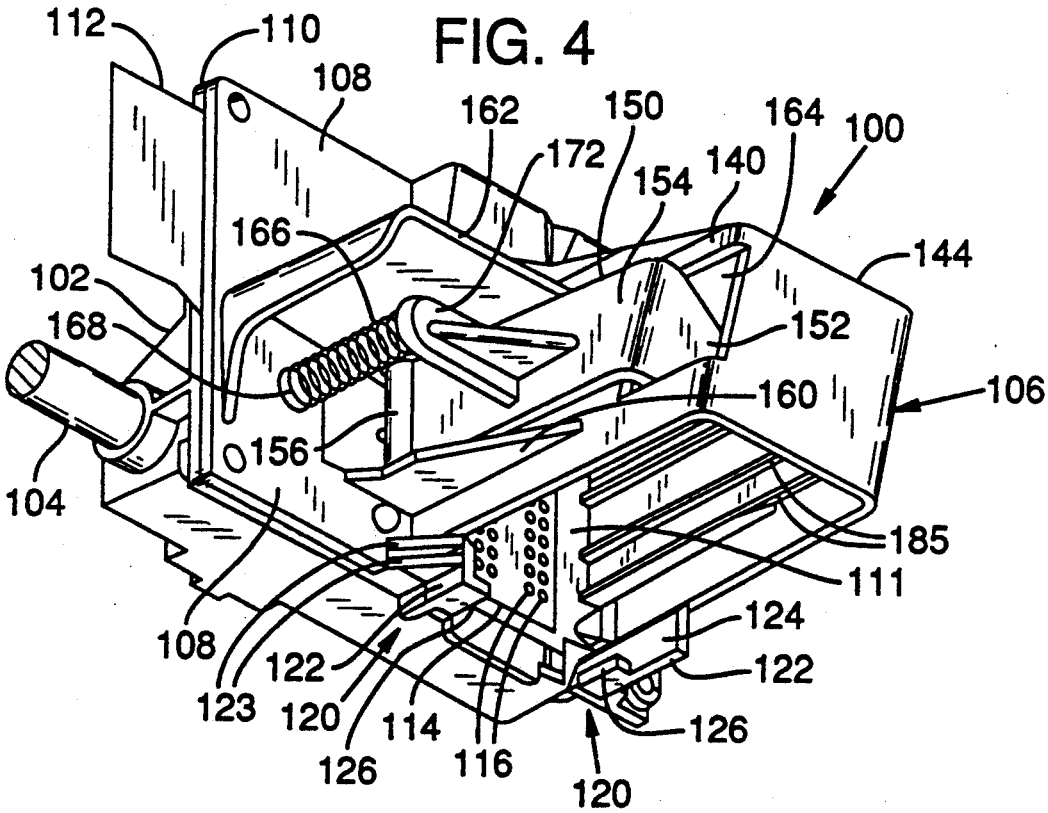
FIG. 4 is a perspective view, from below, of the carriage.

With reference to FIGS. 3 and 4, the carriage 100 of the present invention includes a base 102 that is supported for sliding movement along a shaft 104 so that a pen installed in the carriage 100 may be reciprocated, or scanned, back and forth across the paper that is fed through the printer. The base 102 and associated control mechanisms for providing the reciprocal movement may be, for example, such as that employed with the above-referenced "DeskJet" printer.

The carriage 100 includes a chute assembly 106 that is fastened to the base 102. To this end, the chute assembly 106 includes a generally flat mounting plate 108 that is fastened against a base plate 110 formed in the carriage base 102.

A flexible ribbon-type conductor 112 is secured between the fastened mounting plate 108 and base plate 110. The ribbon conductor 112 terminates at a carriage-mounted circuit 114 that is mounted to the base plate 110. The circuit 114 is mounted to a portion of the outer surface 111 of the base plate 110 that is not covered by the chute assembly mounting plate 108. The circuit 114 is, therefore, exposed for connection with a pen-mounted circuit as described below.

The circuit 114 includes contact pads 116 (shown enlarged for illustration) that are connectable with either the contacts pads 30 of the black pen circuit 28 or the contact pads 68 of the color pen circuit 66, depending upon which pen is installed in the carriage 100.

Turning first to the installation of a black pen 20, and with particular reference to FIGS. 4–6 and 6A, the carriage 100 includes a pair of features 120 that contact and support the reference members 36 on each side of the black pen 20. Each feature 120 includes a flat, generally vertical support bracket 122 formed in the base 102 to protrude outwardly from the base surface 111, one bracket 122 on either side of, and beneath, the carriage-mounted circuit 114. A pair of stiffening gussets 123 are formed between the base plate 110 and each bracket 122. The distance between the facing inner surfaces 124 of the support brackets 122 is established to be slightly greater than the width "W" of the black pen 20 and color pen 60.

Each feature 120 also includes an inwardly protruding lip 126 formed on the bottom of each bracket 122. The lip 126 of each bracket is spaced slightly away from the base outer surface 111, thereby providing between that surface 111 and the forward edge of the lip 126 a gap 128, best seen in FIG. 5. The upper surface 130 (FIG. 6) of the lip 126 contacts and supports the horizontal reference surface 38 of the black pen 20, and the toe 40 of the black pen reference member 36 fits within the gap 128 between the lip 126 and base outer surface 111.

The chute assembly 106 is configured for directing the pen reference members 36 into contact with the features 120 of the carriage. More particularly, the chute assembly 106 includes a left guide wall 140 and a right guide wall 142 that are formed to protrude outwardly from the mounting plate 108 on opposing sides of the carriage-mounted circuit 114. The outermost ends of the left guide wall 140 and right guide wall 142 are joined by a back guide wall 144 extending therebetween. The upper edges of the left guide wall 140, right guide wall 142 and back guide wall 144 define a chute opening 146 into which a user inserts, bottom-first, a pen that is to be installed in the carriage 100.

The effective depth of the opening 146, in particular, the unobstructed distance measured from the base surface 111 toward the back guide wall 144, is normally defined by the presence of a displaceable spacer 150 that is mounted to the chute assembly 160 so that the tip 152 of the spacer 150 protrudes between the base surface 111 and the back guide wall 144.

Figure 8:
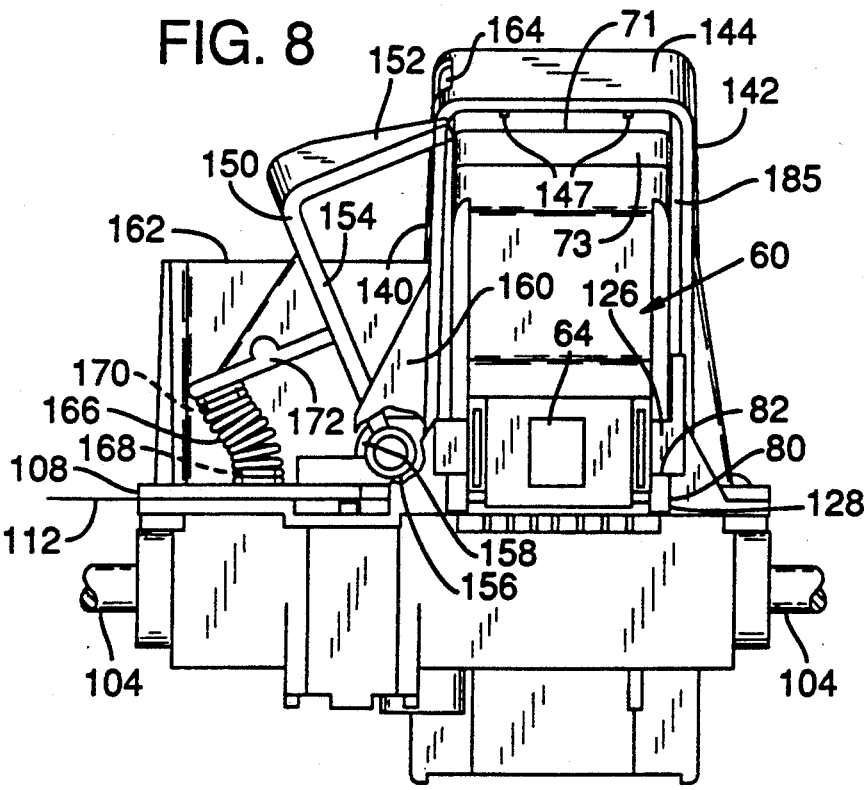
FIG. 8 is a bottom view of the carriage showing a color pen installed therein.

In the preferred embodiment, the spacer 150 is a generally L-shaped member having a flat, straight leg 154 that terminates at its innermost end in a pivot tube 156 (FIGS. 4 and 8). The lower end of the pivot tube 156 has its lower end pivotally secured to an arcuate protrusion 158 in a lower pivot bracket 160. The upper end of the tube 156 is also pivotally secured to an arcuate protrusion 158 in a flat, upper pivot bracket 162. The outermost end of the spacer leg 154 is bent to form the above-mentioned tip 152, which protrudes inwardly at a generally 90° angle relative to the leg 154.

FIGS. 3 and 4 depict the spacer 150 in the normal position, that is, with the tip 152 of the spacer protruding through an opening 164 formed in the left guide wall 140 of the chute assembly 106. The spacer 150 is held in the normal position by a compression spring 166 that has one end anchored to a boss 168 formed in the outer surface of the mounting plate 108 near the pivot brackets 160, 162. The opposing end of the compression spring 166 is anchored to another boss 170 (FIG. 8) that is formed in the outermost end of a spring bracket 172 that extends outwardly from approximately the midpoint of the spacer leg 154.

In view of the foregoing, it can be appreciated that the spacer 150 is mounted for pivotal motion about the protrusions 158 and, in the absence of a countering force, the compression spring 166 expands between the mounting plate 108 and bracket 172 to pivot the spacer 150 into the normal position with the tip 152 extending through the opening 164 in the chute assembly 160. The spacer 150 may be moved to a retracted position (FIG. 8), as described below, wherein the spacer 150 pivots so that the spring 166 compresses and the tip 152 is withdrawn from the opening 164.

With the spacer 150 in the normal position, the effective depth of the chute opening 146 is the distance between the base outer surface 111 and the inner surface 182 (FIG. 6A) of the spacer tip 152. With the spacer 152 in the retracted position, the effective depth of the chute opening is the relatively greater distance between the surface 111 and the inner surface 145 of the back guide wall 144.

Referring to FIGS. 5–8, the upper edge 180 of the spacer tip 152 slopes downwardly in the direction away from the spacer leg 154. Moreover, the inner surface 182 (FIG. 6) of the spacer tip 152 is angled to slope downwardly and inwardly (that is, toward the base surface 111). The distance between the spacer tip 152 and the base surface 111 is selected so that whenever a black pen 20 is lowered into the chute opening 146, the effective size of the opening 146 will be reduced by the presence of the tip 152 by an amount such that the rear surface 33 of the black pen 20 will slide downwardly along the inner surface 182 of the spacer tip 152. The tip 152, in conjunction with the left guide wall 140 and right guide wall 142, thereby guide the black pen reference members 36 into contact with the features 120 of the pen carriage 100. More particularly, the inserted pen will slide through the chute opening 146 until the horizontal reference surfaces 38 on each side of the pen 20 come to rest on the upper surface 130 of each feature lip 126. When the pen is so positioned (FIG. 6), hereafter referred to as the released position, the toe 40 of each pen reference member 36 extends into the gap 128 between the feature lip 126 and the base outer surface 111.

The pen is moved from the released position to an installed position (FIG. 6A) by pushing the pen handle 54 in the direction of the arrow 52 so that the pen pivots about the contacting reference members 36 and features 120 until the upper lip 46 of the pen top is forced beneath the movable free end 192 of a spring clip 190 that is fastened to the carriage. The other end 194 of the spring clip 190 is anchored to a clip housing 196 formed in the carriage 100 above the carriage-mounted circuit 114.

Spaced-apart guides ribs 185 are formed on the inner surfaces of both the left guide wall 140 and the right guide wall 142. The guide ribs 185 define a slightly decreasing width of the chute opening 146 in the direction from the back guide wall 144 toward the base surface 111. Adjacent to the surface 111, the distance between ribs 185 on opposing guide walls 140, 144 is slightly greater than the front face width "W" of the pen. The guide ribs ensure that the pen-mounted circuit 28 is vertically aligned with the carriage-mounted circuit 114 as the pen is moved from the released to the installed position. Moreover, when the pen is in the released position the distance between opposing guide ribs 185 is great enough so that the pen may be easily moved between the left and right guide walls 140, 142.

With the pen 20 in the installed position, the horizontal surface 38 of each reference member 36 is pressed by the clip 190 against the upper surface 130 of the feature lip 126, and the vertical reference surface 42 of each reference member 36 bears against the forward face of the lip 126. Moreover, the contact pads 30 of the pen-mounted circuit 28 are pressed against the contact pads 116 of the carriage-mounted circuit 114. Preferably, a thin resilient member is placed between the base surface 111 and the carriage-mounted circuit 114 so that circuit 114 protrudes slightly outwardly from the base surface 111, thereby ensuring continuous contact between the contact pads 30, 116 of the two circuits.

As noted, the carriage 100 is configured so that the black pen 20 can be removed and a color pen 60 can be substituted therefor. The black pen 20 is removed by pulling the handle 54 so that the pen, pivoting about the contacting reference members 36 and features 120, moves from the installed position to the released position. The black pen is then lifted through the chute opening 146.

With reference to FIGS. 7–10, the color pen 60, which has a depth $D_c$ relatively greater than the depth $D_b$ of the black pen 20, displaces the spacer 150 as the pen 60 is lowered into the chute opening 146. In this regard, the rear surface 71 of the color pen 60 slides along the inner surface 145 (which surface 145 is inclined to be generally parallel to the above-mentioned inner surface 182 of the spacer tip 152) as the pen is lowered into the chute opening 146. In a preferred embodiment, the inner surface 145 defines a pair of spaced-apart protruding ribs 147 of gradually increasing (in the downward direction) depth. The pen surface 71, therefore, slides along those ribs 147.

Figure 7:
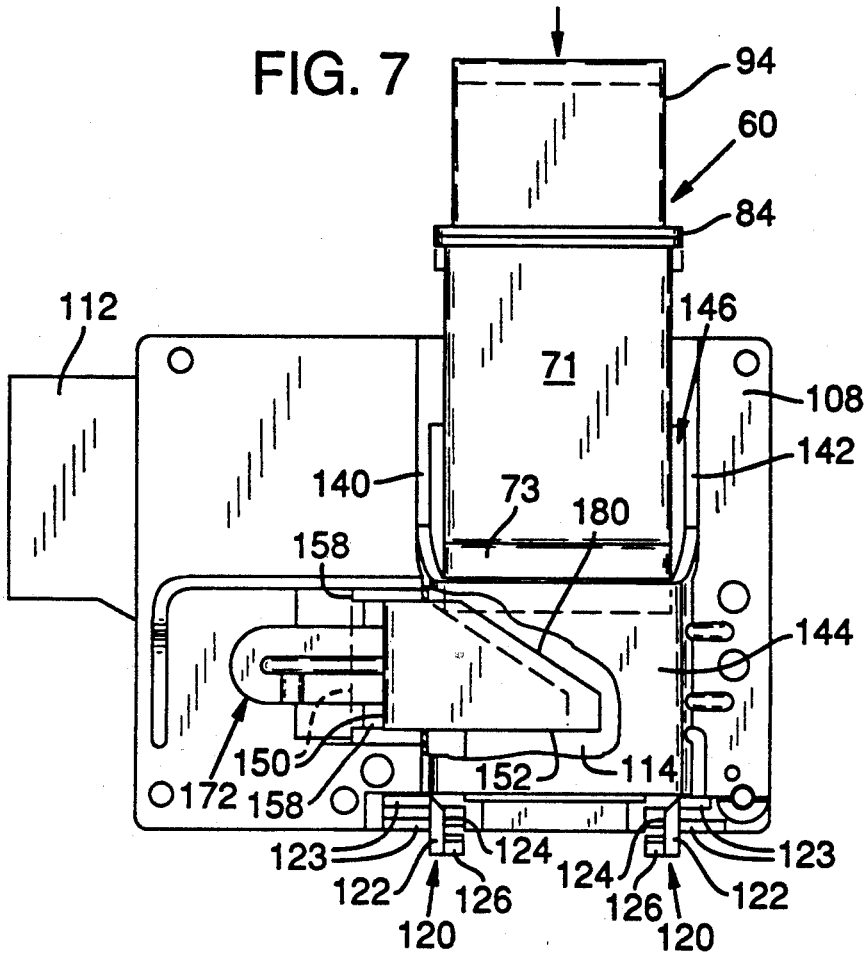
FIG. 7 is a rear elevation view of the carriage showing installation of a color pen.

As best shown in FIG. 7, the lower end of the pen rear surface 71 defines a chamfered surface 73. This surface 73 contacts the downwardly inclined upper edge 180 of the spacer tip 152 as the pen 60 is lowered into the opening 146. As the pen is pushed slightly against the tip 152, there is generated between the contacting surface 73 and tip edge 180 a force component sufficient for causing the spacer to pivot about its pivot tube 156 into the retracted position shown in FIG. 8. In short, the tip 152 is moved out of the opening 146, thereby increasing the effective depth of the opening to accommodate the depth $D_c$ of the color pen 60.

With the spacer 150 in the retracted position, the downward motion of the color pen 60 continues until the vertical reference surface 78 of each pen reference member 76 contacts the feature lip 126 formed in the carriage base. The pen 60, therefore, assumes the released position with the toe 80 of the reference member 76 extending into the gap 128 between the feature lip 126 and the base surface 111.

The color pen 60 is moved into the installed position (dashed lines FIG. 10) by pushing the handle portion 94 in the direction of arrow 92 so that the pen pivots about the contacting reference members 76 and features 120 until the lip 86 of the pen top 84 is clamped by the spring clip 190 in a manner discussed above with respect to the black pen 20. With the color pen 60 in the installed position, the contact pads 68 of the pen-mounted circuit 66 connect with the contact pads 116 of the carriage-mounted circuit 114.

Whenever the color pen 60 is in the installed position, the tip 152 of the spacer 150 continues to contact the pen sidewall 74. Accordingly, the spacer 150 remains in the retracted position (FIG. 8) until the color pen 60 is completely withdrawn from the chute opening 146.

In view of the foregoing, it can be appreciated that the same carriage 100 may be employed to secure either the black pen 20 or color pen 60 in a manner such that their associated orifice plates will be held in the same predetermined position relative to the printer carriage, irrespective of the different shapes of the pens. The chute assembly 106 that provides this pen interchangeability advantage is constructed with passive, automatic mechanisms (spacer 150, etc.) that require no manipulation by the user other than insertion and removal of the pens.

Having described and illustrated the principles of the invention with reference to a preferred embodiment, it should be apparent that the invention can be further modified in arrangement and detail without departing from such principles. For example, any suitable resilient or energy storing device may be used for urging the spacer tip toward the normal position. Moreover, it is contemplated that a spacer member may be configured to be contained completely within the chute guide walls, such as a discrete plate mounted by compressible members to the inner surface 145 of the back guide wall 144. The springs could be configured to hold the discrete plate in a normal orientation substantially matching that of the tip 152 of the spacer member 150.

It should be understood, therefore, that the embodiments described and illustrated above should be considered illustrative only, and not as limiting the scope of the invention. The invention is to include all such embodiments as may come within the scope and spirit of the following claims and equivalents thereto.

What is claimed is:

1. A carriage for a printer, comprising:

a base having features attached thereto for supporting a pen;

a chute assembly attached to the base and defining an opening having a first size, the chute assembly including a first guide part configured for guiding toward the features a pen that has a first shape and that is inserted into the chute opening; and a second guide part mounted to the chute assembly and movable for changing the chute opening to a second size that is different from the first size, the second guide part being configured for guiding toward the features a pen that has a second shape, the second shape being different from the first shape, and that is inserted into the chute opening.

2. The carriage of claim 1 wherein the second guide part is mounted to be normally forced toward a first position wherein a portion of the opening is defined by the second guide part.

3. The carriage of claim 2 wherein the second guide part is movable out of the first position by the first-shaped pen as that pen is inserted into the chute opening.

4. The carriage of claim 2 wherein the first guide part includes a wall through which a portion of the second guide part protrudes when the second guide part is in the first position.

5. The carriage of claim 2 including a resilient member connected to the second guide part for forcing the second guide part into the first position.

6. The carriage of claim 1 wherein the first guide part includes a wall against which one side of the first-shaped pen slides as that pen is guided toward the features, the second guide part having a tip against which one side of the second-shaped pen slides as that pen is guided toward the features.

7. The carriage of claim 6 wherein the second guide part includes a leg to which the tip is attached, the leg being mounted for pivotal movement as the second guide part is moved.

8. The carriage of claim 7 wherein the tip includes an inclined surface contacted by the first-shaped pen as that pen is inserted into the chute opening whereby a force generated by the insertion of the first-shaped pen causes the leg to move.

9. The carriage of claim 1 wherein the first guide part includes a guide wall that is spaced a first distance away from the base, the first distance defining a first depth of the chute opening, the second guide part having a tip part that is movable into a first position between the base and the guide wall thereby to define a second depth of the chute opening as the distance between the base and the tip part.

10. The carriage of claim 9 wherein the second guide part includes a leg having first and second ends, the first end being pivotally mounted to the base, the tip part being attached to the second end, and a spring attached to the leg for forcing the tip part toward the first position.

11. An apparatus for installing a pen in a printer carriage that has features for supporting a pen adjacent to a set of electrical connecting elements carried by the carriage, the apparatus comprising:

a chute assembly attachable to the carriage, the assembly including a chute opening, the chute assembly configured for guiding into contact with the features a first-shaped pen inserted into the chute opening; and guide means for changing the chute opening shape so that a second-shaped pen inserted into the opening is guided by the chute into contact with the features the first-shaped pen having a shape different from the second-shaped pen.

12. The apparatus of claim 11 wherein the chute assembly and the guide means are configured for permitting the first-shaped pen and the second-shaped pen to be interchangeably installed in the carriage in contact with a single set of electrical connecting elements that are carried by the carriage.

13. The apparatus of claim 11 further comprising a clamp mechanism mounted to the carriage for clamping both the first-shaped pen and the second-shaped pen to the carriage.

14. The apparatus of claim 11 wherein the chute assembly includes three walls that define the chute opening, the guide means including a spacer member mounted to the assembly for pivotal movement and a resilient member for urging part of the spacer member through one wall.

* * * * *